US009354571B2

(12) United States Patent
Miura et al.

(10) Patent No.: US 9,354,571 B2
(45) Date of Patent: May 31, 2016

(54) ELECTROPHOTOGRAPHIC MEMBER AND FIXING APPARATUS

(71) Applicant: CANON KABUSHIKI KAISHA, Tokyo (JP)

(72) Inventors: Jun Miura, Kawasaki (JP); Naoki Akiyama, Toride (JP); Katsuhisa Matsunaka, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/623,864

(22) Filed: Feb. 17, 2015

(65) Prior Publication Data

US 2015/0241825 A1 Aug. 27, 2015

(30) Foreign Application Priority Data

Feb. 27, 2014 (JP) ..... 2014-036781

(51) Int. Cl.
*G03G 15/20* (2006.01)

(52) U.S. Cl.
CPC .... *G03G 15/2057* (2013.01); *G03G 2215/2009* (2013.01); *G03G 2215/2029* (2013.01); *G03G 2215/2032* (2013.01)

(58) Field of Classification Search
CPC ..... G03G 15/2057; G03G 2215/2009; G03G 2215/2029; G03G 2215/2032
See application file for complete search history.

(56) References Cited

U.S. PATENT DOCUMENTS

2009/0123203 A1* 5/2009 Tanaka et al. ..... 399/330
2010/0119754 A1* 5/2010 Kurokawa ..... 428/36.9
2013/0149540 A1* 6/2013 Sato et al. ..... 399/302
2013/0164060 A1* 6/2013 Honke ..... G03G 15/2057 399/333
2013/0266339 A1* 10/2013 Sugiyama ..... G03G 15/0818 399/286
2014/0295139 A1* 10/2014 Miyahara et al. ..... 428/147

FOREIGN PATENT DOCUMENTS

JP 2010-143118 A 7/2010

* cited by examiner

*Primary Examiner* — Ryan Walsh
(74) *Attorney, Agent, or Firm* — Fitzpatrick, Cella, Harper & Scinto

(57) ABSTRACT

The present invention relates to an electrophotographic member having electroconductivity for suppressing peeling offset and also having a high cracking resistance. The electrophotographic member has an endless belt shape, and includes a cylindrical or columnar substrate, a rubber elastic layer that covers a periphery of the substrate, and a fluororesin tube that covers a periphery of the rubber elastic layer, wherein the fluororesin tube is crystalline-orientated in a substantially axial direction of the substrate and includes a fluororesin and carbon black dispersed in the fluororesin, and a primary average particle diameter of the carbon black is 50 nm or more and 100 nm or less.

7 Claims, 3 Drawing Sheets

ELECTROPHOTOGRAPHIC MEMBER AND FIXING APPARATUS

BACKGROUND OF THE INVENTION

1. Field of the Invention

The present invention relates to an electrophotographic member and a fixing apparatus for use in an electrophotographic apparatus.

2. Description of the Related Art

In general, a fixing apparatus for use in an electrophotographic system such as a laser printer or a copier has a fixing member for heating an unfixed toner image on a recording material, and a pressurizing member disposed opposite to the fixing member. Then, the recording material, on which the unfixed toner image is formed, is introduced to a fixing nip formed by the fixing member and the pressurizing member, and the unfixed toner is heated, to thereby allow a toner image to be fixed on the recording material.

An electrophotographic member here used for the fixing member and the pressurizing member is generally a member having a roller shape or a belt shape. In addition, a representative configuration of such an electrophotographic member is a configuration having a cylindrical or columnar substrate, an elastic layer formed on the substrate and a surface layer formed on the elastic layer.

The surface layer is for suppressing the attachment of a toner, a paper dust or the like onto the surface of the electrophotographic member. Japanese Patent Application Laid-Open No. 2010-143118 discloses, as the method for forming the electrophotographic member having such a configuration, a method for covering the periphery of an elastic layer formed on the periphery of a substrate with a fluororesin tube.

The electrophotographic member formed using the fluororesin tube here has the following problem: cracking is easily caused on the surface of the fluororesin tube in the direction along with the longitudinal direction of the electrophotographic member.

SUMMARY OF THE INVENTION

Then, one embodiment of the present invention is directed to providing an electrophotographic member having a surface layer formed by an electroconductive fluororesin tube including carbon black, wherein cracking is hardly caused on the surface layer.

Further, another embodiment of the present invention is directed to providing a fixing apparatus that contributes to the formation of a high-quality electrophotographic image.

According to one aspect of the present invention, there is provided an endless belt-shaped electrophotographic member including a substrate, a rubber elastic layer that covers a periphery of the substrate, and a fluororesin tube that covers a periphery of the rubber elastic layer. The fluororesin tube is crystalline-orientated in a substantially axial direction of the substrate and includes a fluororesin and carbon black dispersed in the fluororesin. The carbon black has a primary average particle diameter of 50 nm or more and 100 nm or less.

According to another aspect of the present invention, there is provided a fixing apparatus including a fixing member, and a pressurizing member that is disposed opposite to the fixing member and that forms the fixing member and a fixing nip, wherein any one or both of the fixing member and the pressurizing member is the above electrophotographic member.

Further features of the present invention will become apparent from the following description of exemplary embodiments with reference to the attached drawings.

DESCRIPTION OF THE EMBODIMENTS

The reason why cracking is caused is because the fluororesin tube is generally formed by subjecting a fluororesin to extrusion from a cyclic die and the molecule of the fluororesin is oriented in parallel with the extrusion direction. The fluororesin tube formed by extrusion usually has a degree of orientation of about 35 to 75 percent (%) to the direction in parallel with the extrusion direction.

Meanwhile, the surface layer of the electrophotographic member may be demanded to be electroconductive. Specifically, when the posterior end of a recording material (paper) introduced to the fixing nip is peeled from the fixing member, friction between the recording material and the fixing member or the pressurizing member may locally charge the surface of the fixing member or the pressurizing member. When the next recording material is introduced to the fixing nip in which the surface of the fixing member or the pressurizing member is locally charged, the unfixed toner image on the recording material may be distorted by charges on the surface of the fixing member or the pressurizing member, to cause defects in an electrophotographic image. Hereinafter, such a phenomenon is sometimes referred to as "peeling offset."

In order to suppress peeling offset, it is effective to remove charges on the surface of the fixing member or the pressurizing member. Then, it is effective therefor to allow the surface layer of any one or both the fixing member and the pressurizing member disposed opposite thereto to be electroconductive, neutralizing the surface layer.

Then, the present inventors have made studies about the use of a fluororesin tube, in which carbon black as an electroconductive particle is dispersed, as the fluororesin tube forming the surface layer of the electrophotographic member. As a result, the present inventors have found the following new problem: in the fluororesin tube that is electroconductive due to dispersion of carbon black, cracking is particularly easily caused in the longitudinal direction of the electrophotographic member. The problem has been particularly remarkably caused in the case where the electrophotographic member is a fixing belt or pressurizing belt having a thin endless belt shape that is demanded to be flexible.

Preferred embodiments of the present invention will now be described in detail in accordance with the accompanying drawings.

The present inventors have made studies about the reason why cracking is caused on a fluororesin tube in which carbon black is dispersed. As a result, the present inventors have found that cracking is caused originating from an aggregate of carbon black in the fluororesin tube.

Figure 1:
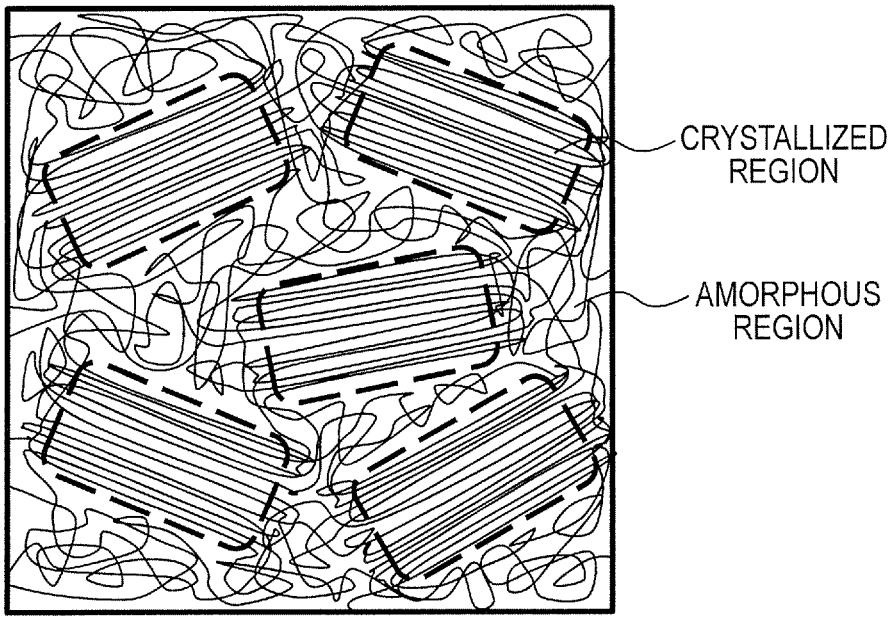
FIG. 1 is a schematic view of a crystalline state of a fluororesin tube.

As illustrated in FIG. 1, a copolymer of tetrafluoroethylene and perfluoroalkyl vinyl ether (hereinafter, sometimes designated as "PFA") as a representative example of a fluororesin for use in an electrophotographic member has a crystallized region, in which a polytetrafluoroethylene (PTFE) backbone is aligned to be crystallized, and a perfluoroalkyl vinyl ether backbone moiety that is hardly crystallized due to the presence of a side chain. Here, specific examples of the perfluoroalkyl vinyl ether include perfluoromethyl vinyl ether [$CF_2$=C(F)—O—$CF_3$], perfluoroethyl vinyl ether [$CF_2$=C(F)—O—$CF_2CF_3$] and perfluoropropyl vinyl ether [$CF_2$=C(F)—O—$CF_2CF_2CF_3$].

Then, carbon black tends to be hardly present in a crystallized region where molecular chains are densely arranged, and tends to be eccentrically located in an amorphous region. Therefore, the distance between carbon black particles is easily closer. It is thus considered that a carbon black aggregate from which cracking of the fluororesin tube originates is easily formed in the amorphous region.

It has been therefore recognized that it is important for inhibiting cracking of the fluororesin tube from being caused to hardly form a carbon black aggregate even when carbon black is eccentrically located in the amorphous region of a fluororesin. The present inventors have made intensive studies about carbon black dispersed in the fluororesin tube, based on such recognition, and have found that carbon black having a primary particle diameter of 50 nm or more and 100 nm or less is effectively used.

In general, an aggregation force between particles is larger as a primary average particle diameter is smaller, and the aggregation force is smaller and such particles are more hardly aggregated as the particle diameter is larger.

When carbon black having a primary average particle diameter of 50 nm or more and 100 nm or less is used, interaction between particles is weak even when such carbon black is eccentrically located in the amorphous region of PFA, and an aggregate is hardly formed. It is thus considered that cracking originating from a carbon black aggregation portion can be inhibited from being caused.

The electrophotographic member according to one embodiment of the present invention and the fixing apparatus including the electrophotographic member are specifically described below with an example.

(1) Fixing Apparatus

Figure 2:
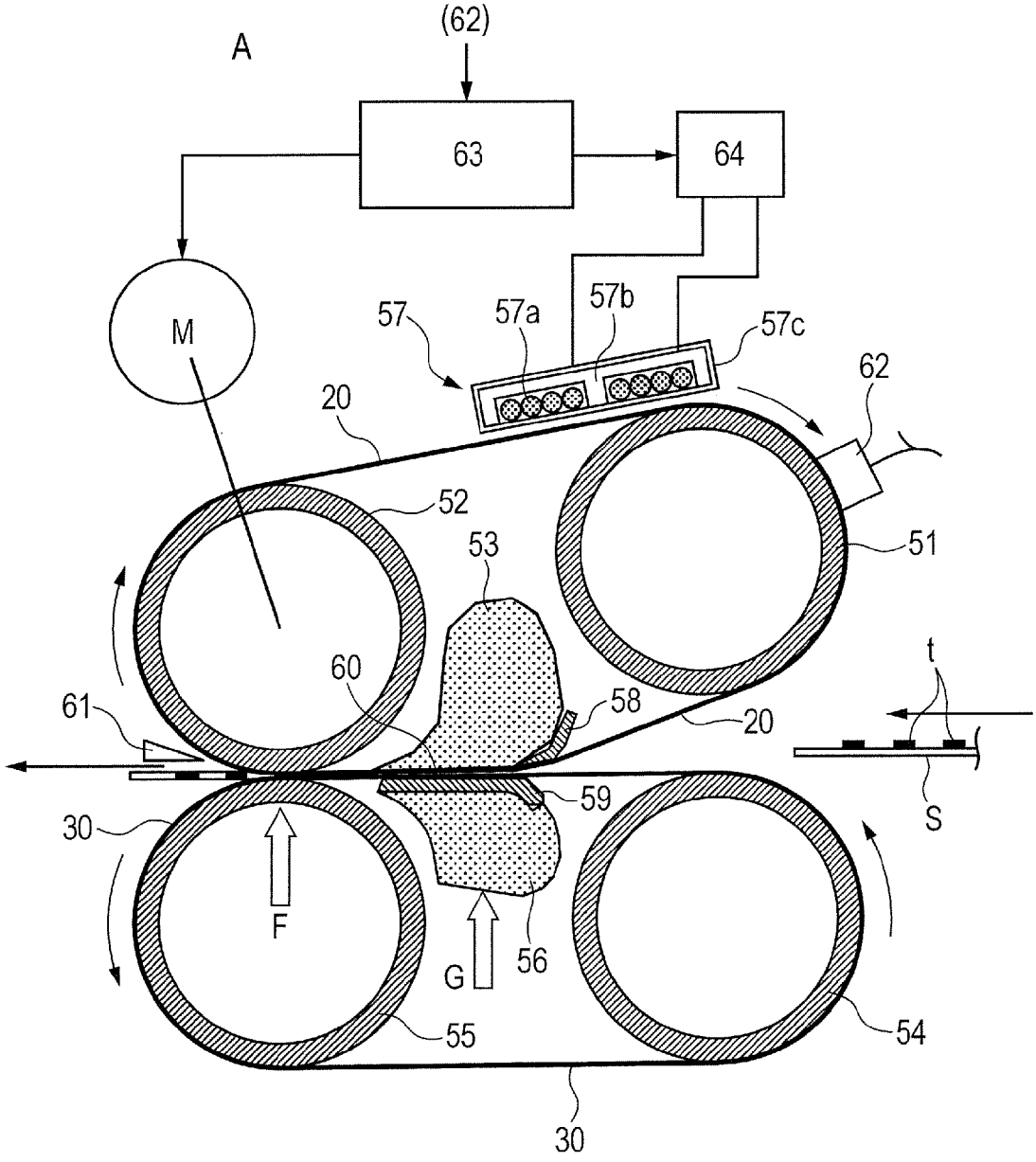
FIG. 2 is a cross-sectional view of one aspect of the fixing apparatus according to the present invention.

FIG. 2 is a cross-sectional view of a fixing apparatus of a so-called twin-belt system, including a fixing belt and a pressurizing belt disposed opposite to the fixing belt. The fixing belt and the pressurizing belt are in contact with each other by pressure and form a fixing nip.

With respect to a fixing apparatus A or a member forming the fixing apparatus A, the longitudinal or longitudinal direction refers to the substrate axis direction of the electrophotographic member (perpendicular to the plane of paper in FIG. 2). The front surface of the fixing apparatus refers to a surface onto which a recording material is introduced. Right and left refer to right and left when the apparatus is viewed from the front surface, respectively. The width of the belt refers to the belt dimension in the belt substrate axis direction (=dimension in the belt longitudinal direction). In addition, the width of the recording material refers to the dimension of the recording material, in the longitudinal direction of the surface of the recording material. In addition, upstream or downstream refers to upstream or downstream in the conveyance direction of the recording material.

The fixing apparatus A, described later in detail, includes a fixing belt 20 as a first endless belt and an electrophotographic member 30 as a second endless belt.

As the heating unit of the fixing belt 20, a heating source (induction heating member, exciting coil) of an electromagnetic induction heating system having a high energy efficiency is adopted. An induction heating member includes an induction coil 57*a*, an exciting core 57*b*, and a coil holder 57*c* that holds the coil and the core. The induction coil 57*a*, in which a litz wire is flat-wound in an oblong manner, is disposed in the exciting core 57*b* having a laterally-facing E shape that protrudes at the center and both edges of the induction coil. The exciting core 57*b* is made using ferrite or permalloy high in permeability and low in residual magnetic flux density, and thus can suppress losses in the induction coil 57*a* and the exciting core 57*b* to effectively heat the fixing belt 20.

When a high-frequency electric current is applied from an exciting circuit 64 to the induction coil 57*a* of the induction heating member 57, a metal layer of the fixing belt 20 inductively generates heat to heat the fixing belt 20. The surface temperature of the fixing belt 20 is detected by a temperature detection element 62 such as a thermistor. The signal about the temperature of the fixing belt 20 detected by the temperature detection element 62 is input to a control circuit unit 63. The control circuit unit 63 controls the electric power supplied from the exciting circuit 64 to the induction coil 57*a* so that the temperature information input from the temperature detection element 62 is maintained at a predetermined fixing temperature, to regulate the temperature of the fixing belt 20 to the predetermined fixing temperature.

The fixing belt 20 is suspended under tension between a roller 51 and a roller 52 that are belt-suspending members. The roller 51 and the roller 52 are each rotatably supported between right and left side plates (not illustrated) of the apparatus by a bearing.

The roller 51 is a hollow roller made of iron, having an outside diameter of 20 mm, an inner diameter of 18 mm and a thickness of 1 mm, and serves as a tension roller that provides tension for the fixing belt 20.

The roller 52 is a highly-slidable elastic roller in which a silicone rubber layer as an elastic layer is provided on a cored bar of an iron alloy, having an outside diameter of 20 mm and a inner diameter of 18 mm. The roller 52 is rotated and driven at a predetermined speed in the clockwise direction indicated by an arrow by applying a driving force via a driving gear train (not illustrated) from a driving source (motor) M as a driving roller. The roller 52 can be provided with the elastic layer as described above to thereby efficiently transmit the driving force applied to the roller 52 to the fixing belt 20, and form a fixing nip that is for ensuring separation property of the recording material, from the fixing belt 20. The silicone rubber layer reduces heat conduction to the inside and thus is effective for shortening a warming-up time.

The fixing belt 20 is rotated together with the roller 52 by the friction between the silicone rubber surface of the roller 52 and an inner surface polyimide layer of the fixing belt 20, when the roller 52 is rotated and driven. The outside diameter of the fixing belt is 55 mm.

The electrophotographic member 30 is suspended under tension by a tension roller 54 and a pressurizing roller 55 as belt-suspending members. The outside diameter of the electrophotographic member is 55 mm. Such suspension tension applies a force in the substrate rotation direction of the electrophotographic member 30, and the electrophotographic member is easily cracked in the longitudinal direction in use for a long period of time. The tension roller 54 and the pressurizing roller 55 are each rotatably supported between right and left side plates (not illustrated) of the apparatus by a bearing.

The tension roller 54 is provided with a silicone sponge layer on a cored bar made of an iron alloy, having an outside diameter of 20 mm and an inner diameter of 16 mm, in order to decrease heat conductivity to reduce heat conduction from the electrophotographic member 30.

The pressurizing roller 55 is a low-slidable rigid roller made of an iron alloy, having an outside diameter of 20 mm, an inner diameter of 16 mm and a thickness of 2 mm.

In order to form a nip unit 60 between the fixing belt 20 and the electrophotographic member 30, both right and left ends of the rotation shaft of the pressurizing roller 55 are pressurized toward the roller 52 at a predetermined pressuring force in the direction of arrow F by a pressurizing mechanism (not illustrated).

In order to obtain a wide nip unit 60 without increasing the size of the apparatus, a pressurizing pad is adopted. That is, a fixing pad 53 as a first pressurizing pad that pressurizes the fixing belt 20 toward the electrophotographic member 30, and a pressurizing pad 56 as a second pressurizing pad that pressurizes the electrophotographic member 30 toward the fixing belt 20 are adopted. The fixing pad 53 and the pressurizing pad 56 are supported and provided between right and left side plates (not illustrated) of the apparatus. The pressurizing pad is pressurized toward the fixing pad 53 at a predetermined pressurizing force by a pressurizing mechanism (not illustrated) in the direction of arrow G. The fixing pad 53 as a first pressurizing pad has a pad substrate and a sliding sheet (low-friction sheet) 58 in contact with the belt. The pressurizing pad 56 as a second pressurizing pad also has a pad substrate and a sliding sheet 59 in contact with the belt. The sliding sheets 58 and 59 can be interposed between the belt and the pad substrate to thereby not only prevent the pad from being ground but also reduce sliding resistance, ensuring good belt travelling property and belt durability.

The fixing belt and the electrophotographic member are provided with a non-contact neutralizing brush (not illustrated) and a contact neutralizing brush (not illustrated), respectively.

The control circuit unit 63 drives a motor M at least in executing of image formation. Thus, the roller 52 is rotated and driven and the fixing belt 20 is rotated and driven in the same direction. The electrophotographic member 30 is rotated following the fixing belt 20. Here, a configuration in which the downmost stream portion of the fixing nip is conveyed with the fixing belt 20 and the electrophotographic member 30 being sandwiched between roller pairs 52 and 55 enables to prevent the belt from being slipped. The downmost stream portion of the fixing nip is a portion where the maximum is obtained in the pressure distribution (the conveyance direction of the recording material) on the fixing nip.

In the state where the temperature of the fixing belt 20 reaches a predetermined fixing temperature and is regulated at the temperature, a recording material S having an unfixed toner image t is conveyed to a fixing nip 60 between the fixing belt 20 and the electrophotographic member 30 in the arrow direction. The recording material S is introduced while a surface on which the unfixed toner image t is carried faces the fixing belt 20.

Then, the unfixed toner image t of the recording material S is held and conveyed while being closely-attached to the outer periphery of the fixing belt 20, and thus receives heat from the fixing belt 20 and undergoes a pressurizing force to be fixed on the surface of the recording material S. Thereafter, the recording material S is separated from the fixing belt by a separating member 61 and conveyed.

Figure 3:
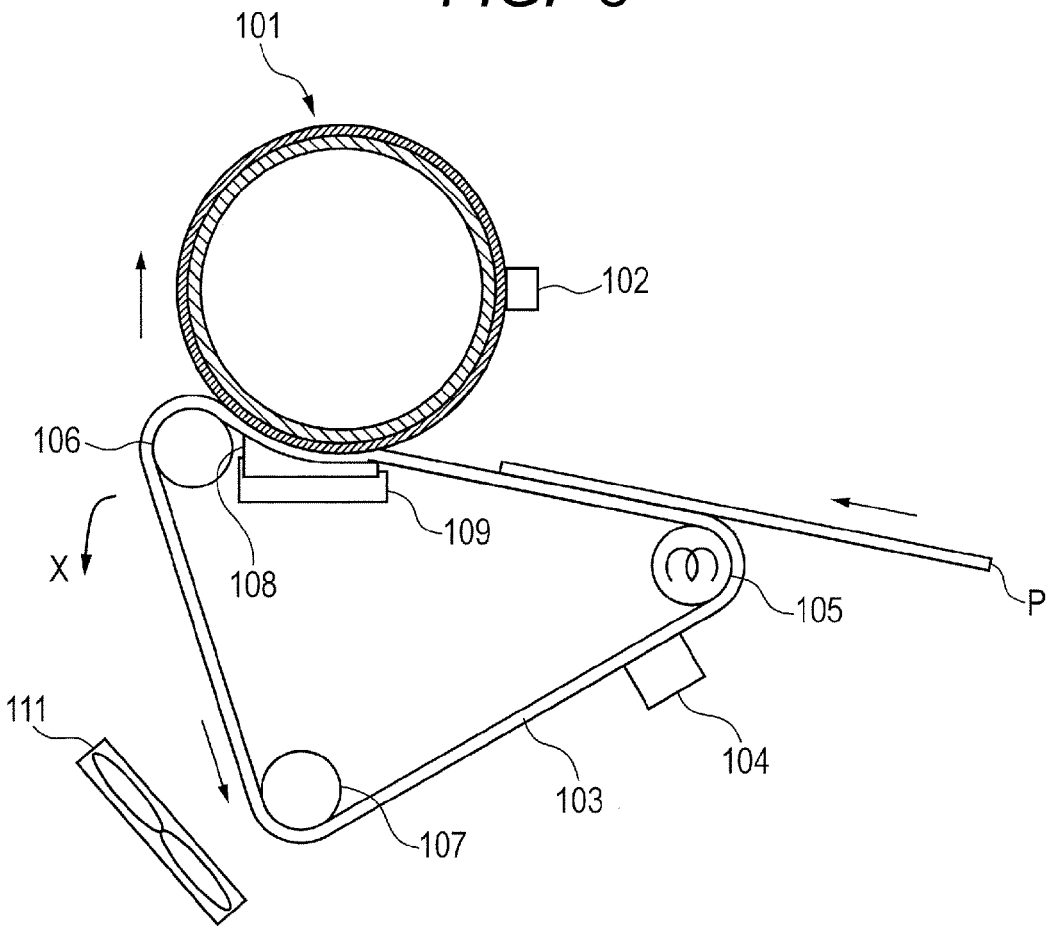
FIG. 3 is a cross-sectional view of another aspect of the fixing apparatus according to the present invention.

FIG. 3 is a cross-sectional schematic view of one example of the fixing apparatus having a pair of fixing rollers heated and an electrophotographic member, which is another example of the fixing apparatus including the electrophotographic member according to the present invention.

As illustrated in FIG. 3, a fixing roller 101 abuts a main thermistor 102 disposed at the center portion. An electrophotographic member 103 abuts a belt thermistor 104. An endless belt-shaped electrophotographic member 103 is rotatably supported and suspended under tension by a plurality of rollers 105 to 107. The electrophotographic member 103 abuts a fixing roller 101. A fixing apparatus of a belt fixing system is adopted in which the electrophotographic member 103 is pressurized to the fixing roller 101 from the inside of the electrophotographic member 103 via a sliding member (not illustrated) by a pressurizing member having a pressurizing pad 108 and a pressurizing pad support 109 to form a fixing nip unit. The fixing roller 101 is rotated and driven in the clockwise direction indicated by an arrow. The electrophotographic member 103 is rotated in the direction indicated by an arrow, following rotation of the fixing roller 101. A halogen heater 110 as a heating source is provided inside the fixing roller 101.

A main thermistor 102 is in contact with and provided on a paper-feeding portion (substantially central portion in the longitudinal direction of the fixing roller) of the fixing roller 101, and controls a voltage to be supplied to the heater via a temperature regulation circuit (CPU) to thereby perform temperature adjustment so that the temperature on the surface of the fixing roller 101 is 180° C. In addition, a sub-thermistor (not illustrated) abuts a paper-non-feeding portion (end region over a region through which a usable recording material having the maximum width passes) at the end of the fixing roller 101 in the longitudinal direction. The roller 106 among the rollers 105 to 107 by which the electrophotographic member 103 is suspended and rotated is a separation roller made of metal. The roller 106 pressurizes the fixing roller 101 so as to press the fixing roller 101 with the electrophotographic member 103 interposed, thereby deforming an elastic member of the fixing roller 101 to separate the recording material P from the surface of the fixing roller 101.

In addition, the roller 106 is rotatable in the direction of arrow X with the roller 105 as the turning center. A heater for heating the electrophotographic member is built in the roller 105, and a voltage to be supplied to the heater is controlled depending on the temperature of the electrophotographic member detected by a belt thermistor 104 via a temperature regulation circuit (CPU). The pressurizing pad 108 has a configuration where an elastic member of a silicone rubber, a fluororubber or the like is placed on a metallic seat, and pressurizes the fixing roller 101 with the electrophotographic member 103 interposed.

In order to decrease the sliding resistance between the pressurizing pad 108 and the electrophotographic member 103, a resin sheet can be provided between the pressurizing pad and the electrophotographic member, and the inner surface of the electrophotographic member 103 can be coated with a lubricant. As described above, when the fixing roller 101, and the endless belt-shaped electrophotographic member 103 and the pressurizing pad 108 form a fixing nip unit, a wide fixing nip unit can be formed by the electrophotographic member 103 so as to be wound on the outer circumference of the fixing roller 101, an increase in speed can be realized, and fixing to cardboard or the like is advantageously conducted. A cooling fan 111 is placed at a position where the electrophotographic member 103 is cooled, and the operation thereof is controlled by a control circuit (CPU).

(2) Electrophotographic Member

Figure 4:
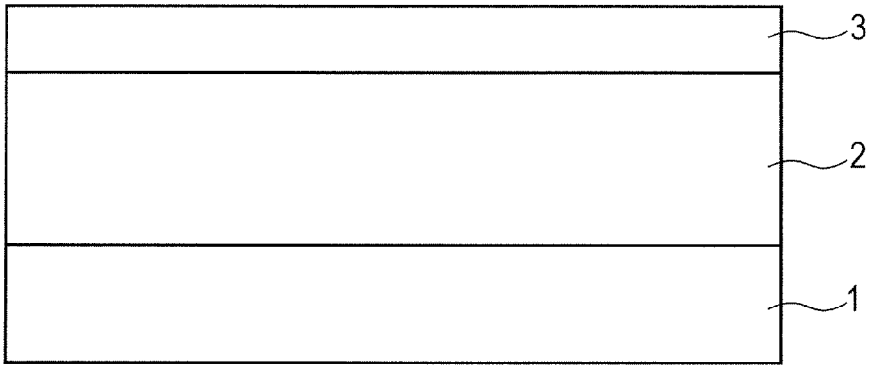
FIG. 4 is a schematic cross-sectional view of the electrophotographic member according to the present invention.

FIG. 4 is a schematic cross-sectional view of the electrophotographic member according to the present invention. The electrophotographic member according to the present invention has an endless belt shape, and is configured to have at least a cylindrical substrate 1, a rubber elastic layer 2 and a fluororesin tube 3. With respect to adhesion between respective layers, an adhesion layer may be appropriately provided. A sliding layer may also be provided on the inner surface of the substrate for the purpose of imparting sliding property. The detail is indicated below.

(2-1) Substrate

An endless belt-shaped substrate made of a metal such as aluminum, iron, stainless steel or plated nickel, or a resin excellent in heat resistance, such as polyimide, is used as the substrate 1. The thickness of the substrate 1 can be 30 μm or more and 70 μm or less.

(2-2) Rubber Elastic Layer

The rubber elastic layer 2 is for allowing the fixing member to have elasticity so that the fixing member does not excessively press and collapse a toner in fixing. In order to exhibit such a function, the rubber elastic layer 2 can be made of a cured product of an addition curing type silicone rubber. The reason is because elasticity can be adjusted depending on the type of a filler such as silica or alumina and the amount thereof added. The degree of crosslinking can also be adjusted to thereby adjust elasticity. The thickness of the rubber elastic layer 2 is preferably 100 μm or more and 1000 μm or less, particularly preferably 200 μm or more and 400 μm or less. The layer formation method includes, but not particularly limited, a method of performing a common ring-coating method and then crosslinking and curing.

(2-3) Fluororesin Tube

The thickness of the fluororesin tube 3 can preferably be 35 μm or more and 55 μm or less from the point of flexibility.

(2-3-1) Fluororesin Material

A tetrafluoroethylene/perfluoroalkyl vinyl ether copolymer (PFA) excellent in heat resistance can be used as the fluororesin forming the fluororesin tube. A PFA tube, molded by extrusion, is used. The copolymerization type of PFA serving as a raw material is not particularly limited, and examples include random copolymerization, block copolymerization and graft copolymerization. In addition, the molar ratio of tetrafluoroethylene (TFE) to perfluoroalkyl vinyl ether (PAVE) contained in PFA serving as a raw material is not particularly limited. PFA can be confirmed by $^{19}$F-NMR.

(2-3-2) Carbon Black

In order to impart electroconductivity to the fluororesin to reduce the surface resistance of the electrophotographic member, the fluororesin tube 3 contains carbon black. The type of carbon black is not particularly limited, and examples include acetylene black, furnace black and channel black. The type of carbon black can be confirmed by the Raman spectroscopy.

The primary average particle diameter of carbon black contained in the fluororesin tube 3 is 50 nm or more and 100 nm or less. The average particle diameter of carbon black in the present invention refers to the average particle diameter of a primary particle that can be determined by measurement described later. When the average particle diameter is less than 50 nm, carbon black easily aggregates and thus cracking originating from such an aggregate is easily caused. When the average particle diameter is more than 100 nm, the surface property of the fluororesin tube 3 of the electrophotographic member deteriorates, therefore the fixed image surface is brought into contact with the electrophotographic member in second face fixing of double-face printing, and thus the gloss of an image may deteriorate.

The average particle diameter of carbon black can be measured by the following method.

First, the electrophotographic member of the present invention is cut out and embedded in a resin so that the cross section is exposed, thereafter the sample is subjected to mechanical lapping and then mirror mechanical polishing to produce a mirrored cross section. Then, the resultant is subjected to etching by an argon ion beam using a flat milling apparatus (for example, E-3200 Model manufactured by Hitachi High-Technologies Corporation) to expose a carbon black particle at the minimum necessary level. In order to prevent charging in electron microscope observation, a thin film of gold, platinum or the like is imparted to the surface of the sample by sputtering or vapor deposition as needed. The sample subjected to such a pre-treatment is observed by an electron microscope (product name: XL-30, manufactured by FEI) at a magnification of 500, and the observation image of the cross section of the fluororesin tube is recorded as digital data. In the image analysis, 50 primary particles of carbon black are chosen, and particle diameters thereof are measured. Here, the particle diameter is an area-equivalent diameter, i.e. a diameter of a circle whose area is equivalent to an area of the primary particle of carbon black in the image.

The same operation is conducted to perform measurement with respect to the cross sections at any 10 points of the electrophotographic member, and the average is defined as the primary average particle diameter. Any commercially available analysis software can be used for the image analysis and is not limited as long as such software can conduct a required analysis. In the present example, Image-Pro Plus 5.0J (manufactured by Media Cybernetics) is used.

(2-3-3) Degree of Crystalline Orientation of Fluororesin Tube

In the fluororesin tube formed by an extrusion method, the degree of crystalline orientation in the direction along with the extrusion direction (the longitudinal direction of the substrate of the electrophotographic member) is usually in the range of 35% or more and 75% or less.

A fluororesin tube having a degree of crystalline orientation of 50% or less in the direction along with the extrusion direction can be used as the fluororesin tube in the present invention.

In the fluororesin tube having a degree of crystalline orientation of 50% or less in the direction along with the extrusion direction, the orientation in the direction along with the extrusion direction of a fluororesin molecule does not excessively progress. Therefore, cracking in the direction perpendicular to the extrusion direction, namely, cracking in the circumferential direction of the fluororesin tube is relatively hardly caused. On the other hand, as described above, the degree of crystalline orientation in the direction along with the extrusion direction of the fluororesin tube formed by extrusion is usually 35% or more. Therefore, a fluororesin tube having a degree of crystalline orientation of 35% or more and 50% or less in the direction along with the extrusion direction can be suitably used as the fluororesin tube in the present invention.

The degree of crystalline orientation of the fluororesin tube can be determined by calculating the degree of crystalline orientation by the wide-angle X-ray diffraction method as described later. That is, the intensity distribution along the Debye ring with respect to a crystalline orientation sample is used, and the degree of crystalline orientation is measured using the X-ray diffraction image. The 2θ is set to the peak derived from a PTFE crystal around 18° using a sample stage for fibers, and 360° rotation (β rotation) is made to measure the intensity distribution along the Debye ring, determining the degree of crystalline orientation according to the following expression (1). Herein, a rotating target type X-ray diffraction apparatus RINT 2500 Model (X-ray: CuKα) manufactured by Rigaku Corporation is used as the X-ray diffraction apparatus.

$$H=[(360-\Sigma W/360)]\times 100 \quad \text{Expression (1)}$$

In expression (1), H represents the degree of crystalline orientation and W represents the half-value width.

(2-3-4) Surface Resistance

The surface resistance of the fluororesin tube 3 can be $1\times10^{7}$ Ω/m$^2$ or more and $1\times10^{12}$ Ω/m$^2$ or less. When the surface resistance is controlled within the range, peeling offset is effectively suppressed. The surface resistance value is obtained by measuring the surface resistivity at an application voltage of 500 V, a measurement time of 25 seconds, a measurement temperature of 20° C. and a humidity of 50% using Hiresta UP MCP-HT 450 (manufactured by Mitsubishi Chemical Corporation, probe: UA). Measurement is made at 16 points on the outer periphery of the belt, and the average is defined as the surface resistivity of the belt.

(2-3-5) Production Method of Fluororesin Tube

The fluororesin tube 3 can be formed by extrusion. That is, a molded product is obtained by supplying a fluororesin mixture including a fluororesin and carbon black to an extruder, heat-melting the mixture, extruding the mixture through a mold (die) having a ring shape of a predetermined size, and cooling the mixture extruded.

For example, when a fluororesin tube having a diameter of 30 mm is produced by extrusion, first, a pellet-like material is supplied to a cylinder unit (extrusion screw unit) of an extruder, and kneaded with heating and extruded at an extrusion speed of 40 to 60 g/min. The temperature of the cylinder unit is here gradually raised. Then, the resultant is usually extruded in a tubular shape through a ring-shaped discharge port having an inner diameter of 50 mm and a gap of 5 mm in the state of being completely molten at 320° C. to 400° C., but depending on the size of the extruder and the retention time, and the extruded product is cooled through a sizing die with being taken up, to thereby have a fitted inner diameter.

The thickness of the fluororesin tube is controlled with respect to the drawdown ratio (area of discharge port of mold/cross-sectional area of molded tube), and adjusted with respect to the extrusion speed and the take-up speed. A tube having a thickness of 20 to 70 μm is obtained at a take-up speed of 2.0 m/min to 8.0 m/min and a drawdown ratio of 130 to 450. As the molding temperature is higher or the take-up speed is lower, the cooling time is longer and the degree of crystallization is higher. In addition, the degree of orientation is higher as the extrusion speed is lower and the take-up speed is higher.

The fluororesin tube formed by an extrusion method described above usually has a degree of crystallization in the range of 20 to 55, and a degree of orientation in the range of 35 to 75% in the longitudinal direction. The thickness of the fluororesin tube can be 50 μm or less for the purpose of an enhancement in fixing efficiency, as described above. The reason is because the elasticity of the silicone rubber layer as an underlayer in stacking can be maintained to inhibit the surface hardness of the fixing member from being too high. On the other hand, the thickness can be 10 μm or more from the viewpoint of maintaining the strength of the fluororesin tube.

The inner diameter of the fluororesin tube is preferably smaller than the outside diameter of the cylindrical elastic layer, in order to subject the fluororesin tube to a modifying step described later. Specifically, the cylindrical elastic layer can be molded so as to provide an inner diameter so that the difference between the inner diameter of the fluororesin tube after inserting and the inner diameter of the fluororesin tube before inserting is within the range from 4% or more to 7% or less based on the inner diameter before inserting.

The inner surface of the fluororesin tube can have enhanced adhesiveness by a sodium treatment, an excimer laser treatment, an ammonia treatment or the like in advance.

EXAMPLES

Hereinafter, the present invention is more specifically described with reference to Examples. Herein, while these Examples are examples of embodiments to which the present invention can be applied, the present invention is not limited to only these Examples, and various modifications can be made within the scope of the present invention.

Example 1

Preparation of Fluororesin Tube

A fluororesin tube for use in the present Example was prepared according to the following method.

First, 8.5 parts by mass of carbon black (product name: Denka Black, produced by Denki Kagaku Kogyo K. K., primary average particle diameter: 95 nm) and 100 parts by mass of PFA (trade name: AP201, produced by Daikin Industries, Ltd.) were mixed and melt-kneaded, and then pelletized to obtain a pellet. Then, the pellet was introduced into an extruder to which a ring-shaped die having an inner diameter of 75 mm, and a die gap of 0.8 mm, was connected. The pellet was heated at 390° C. in the extruder and extruded through the ring-shaped die at an extrusion speed of 53 g/min, to provide a PFA tube, in which carbon black was dispersed. The extruded PFA tube was taken up at a take-up speed of 2.5 m/min, to provide an electroconductive fluororesin tube having a thickness of 56 μm and an inner diameter of 53 mm. Regarding the resulting fluororesin tube, primary average particle diameter of carbon black dispersed therein, a degree of crystalline orientation, and a surface resistance were measured based on the aforementioned method, and the thickness of the fluororesin tube was also measured. The results were shown in Table 1.

Next, an inner periphery of the resulting fluororesin tube was subjected to an inner surface treatment with a surface treatment agent (trade name: TETRAETCH, produced by Junkosha, Inc.).

Then, the outer surface of a plated nickel belt was coated with a primer (product name: DY39-051, produced by Dow Corning Toray) and heat-treated. The surface thereon was coated with an addition curing type silicone rubber by using the ring coating method, and the resultant was heated for curing to form a rubber elastic layer. Then, the rubber elastic layer coated with an adhesive (product name: SE1819CV, produced by Dow Corning Toray) was covered with the electroconductive fluororesin tube prepared above, and the adhesive was cured to provide an electrophotographic member according to the present Example.

Examples 2 to 9

Fluororesin tubes for electrophotographic members according to Examples 2 to 9, were prepared as the same method as that of the fluororesin tube according to Example 1 except that ring-shaped dies, extrusion speeds, take-up speeds and carbon black were changed.

Regarding ring-shaped dies, ring-shaped dies having inner diameters and die gaps as shown in Table 2 were prepared.

The extrusion speeds and the take-up speeds, are shown in Table 2. Further, the carbon blacks used in Examples 2 to 9 are shown below. Regarding the resulting fluororesin tubes, primary average particle diameter of carbon black dispersed therein, a degree of crystalline orientation, and a surface resistance were measured based on the aforementioned method, and the thickness of the fluororesin tube was also measured. The results were shown in Table 1.

Next, by using the resulting fluororesin tubes, electrophotographic members according to Examples 2 to 9 were produced in the same manner as that of Example 1.

<Carbon Black in Example 2>

Product name: "Seast FM FEF-HS" (produced by Tokai Carbon Co., Ltd.)

Primary average particle diameter: 50 nm

<Carbon Black in Each of Examples 3, 5, 6, 7, 8 and 9>

Product name: "Seast FY SRF-HS" (produced by Tokai Carbon Co., Ltd.)

Primary average particle diameter: 72 nm

<Carbon Black in Example 4>

Product name: "#3030B" (produced by Mitsubishi Chemical Co., Ltd.)

Primary average particle diameter: 55 nm

Comparative Example 1

A fluororesin tube for an electrophotographic member according to Comparative Example 1 was prepared in the same manner as that of the fluororesin tube in Example 1, except that the ring-shaped die, the extrusion speed and take-up speed were changed as shown in Table 2. Further, as carbon black, carbon black having a small average particle diameter (product name: Denka Black, produced by Denki Kagaku Kogyo K. K., primary average particle diameter: 35 nm) was used. Regarding the resulting fluororesin tube, primary average particle diameter of carbon black dispersed therein, a degree of crystalline orientation, and a surface resistance were measured based on the aforementioned method, and the thickness of the fluororesin tube was also measured. The results were shown in Table 1.

Next, an electrophotographic member according to Comparative Example 1 was obtained by the same method as in Example 1 except that the above prepared fluororesin tube was employed.

Comparative Example 2

A fluororesin tube for producing an electrophotographic member according to Comparative Example was prepared in the same manner as that of the fluororesin tube in Example 1, except that the ring-shaped die, the extrusion speed and take-up speed were changed as shown in Table 2. Further, carbon black was not used. Regarding the resulting fluororesin tube, a degree of crystalline orientation, and a surface resistance were measured based on the aforementioned method, and the thickness of the fluororesin tube was also measured. The results were shown in Table 1.

Next, an electrophotographic member according to Comparative Example 2 was obtained by the same method as in Example 1 except that the above prepared fluororesin tube was used.

(Evaluation)

The electrophotographic member in each of Examples 1 to 9 and Comparative Examples 1 to 2 was mounted to the above fixing apparatus of a twin-belt system, and the fixing apparatus was set to IMAGE RUNNER ADVANCE C7065 (trade name; manufactured by Canon Inc.) to perform the evaluation of cracking resistance and the evaluation of peeling offset as follows. In both the evaluations, it was determined that an electrophotographic member having a sufficient cracking resistance and no peeling offset caused highly satisfied both cracking resistance and peeling offset requirements.

(Evaluation Method of Cracking Resistance)

The electrophotographic member prepared in each of Examples and Comparative Examples was mounted to the above fixing apparatus. The process speed was set to 348 mm/sec. 3000000 sheets of A4 size of High-quality color laser copier paper (basis weight of 80 g/m$^2$) (manufactured by Canon Inc.) were continuously fed (70 sheets/min) with the shorter side of the printing surface being directed to the conveyance direction of the recording material. Then, one sheet of coat paper (trade name: OK Topcoat, manufactured by Oji Paper Co., Ltd., basisr weight=128 g/m$^2$) was fed, and a uniform cyan halftone image was formed thereon. Hereinafter, the resultant cyan image is called "first cyan image". The first cyan image was visually observed whether or not an image defect such as scratches, stripes and variation in gloss was confirmed.

In addition, at the time when the first cyan image was formed, the surface of the electrophotographic member was visually observed whether or not a crack was confirmed.

When no image defect was confirmed on the first cyan image, and no crack was confirmed, 1000000 sheets of the High-quality color laser copier paper were further fed. Then, one sheet of coat paper (trade name: OK Topcoat, manufactured by Oji Paper Co., Ltd., basis weight of 128 g/m$^2$) was fed, and a uniform cyan halftone image was formed thereon. Hereinafter, the resultant cyan image is called "second cyan image". The second cyan image was visually observed whether or not an image defect such as scratches, stripes and variation in gloss was confirmed.

In addition, at the time when the second cyan image was formed, the surface of the electrophotographic member was visually observed whether or not a crack was confirmed.

When no image defect was confirmed on the second cyan image, and no crack was confirmed, 1000000 sheets of the High-quality color laser copier paper were further fed. Then, one sheet of coat paper (trade name: OK Topcoat, manufactured by Oji Paper Co., Ltd., basis weight of 128 g/m$^2$) was fed, and a uniform cyan halftone image was formed thereon. Hereinafter, the resultant cyan image is called "third cyan image". The third cyan image was visually observed whether or not an image defect such as scratches, stripes and variation in gloss was confirmed.

In addition, at the time when the third cyan image was formed, the surface of the electrophotographic member was visually observed whether or not a crack was confirmed.

Based on the observation of the first, second and third cyan images, and the observation of the surface of the electrophotographic member, evaluation was made according to the following criteria. Herein, evaluation rank D was determined in the present invention as follows: the cracking resistance was insufficient.

| Evaluation ranks | Criteria |
|---|---|
| A | Neither image failures nor cracking was caused even in feeding of 5000000 sheets. |
| B | Image defects or cracking was caused in feeding of 4000000 sheets. |
| C | Image defects or cracking was caused in feeding of 3000000 sheets. |
| D | Image defects or cracking was caused in feeding of less than 3000000 sheets. |

(Evaluation Method of Peeling Offset)

The electrophotographic member prepared in each of Examples and Comparative Examples was mounted to the above fixing apparatus. The process speed was set to 348 mm/sec.

A first cut paper and second cut paper were prepared. The first cut paper has a basis weight of 209 g/m$^2$, length of 450 mm and width of 320 mm. The second cut paper has a basis weight of 220 g/m$^2$, and A3 size.

The test was performed in an environment of room temperature, 23° C., and a humidity of 15% RH. The image forming apparatus and the cut papers were left to stand under the environment. First, 100 sheets of the first cut paper were continuously fed in order to be a potential of the entire paper-feeding region of the electrophotographic member, i.e. fixing belt, was constant. Thereafter, 5 sheets of the second cut paper were fed and a halftone image was formed on the every second cut sheet. Then, the halftone image on the second cut sheet which was finally fed, was visually observed whether or not image failures such as stripes and variation in gloss were confirmed by five persons. Evaluation was made as follows.

Rank A: a case where image failures were pointed out by no persons.

Rank B: a case where image failures were pointed out by one person.

Rank C: a case where image failures were pointed out by two persons.

Rank D: a case where image failures were pointed out by three or more persons.

Rank D was determined in such ranking as follows: clear image failures were observed, namely, image failures were caused due to peeling offset.

(Results)

The results of the evaluation of cracking resistance and the evaluation of peeling offset were shown in Table 1.

TABLE 1

| | Primary average particle diameter nm | Degree of crystalline orientation % | Thickness μm | Surface resistance Ω/m$^2$ | Evaluation of cracking resistance | Evaluation of peeling offset |
|---|---|---|---|---|---|---|
| Example 1 | 95 | 35 | 55 | $1 \times 10^{12}$ | A | B |
| Example 2 | 50 | 50 | 35 | $1 \times 10^{7}$ | B | A |
| Example 3 | 72 | 42 | 46 | $3 \times 10^{11}$ | A | A |
| Example 4 | 55 | 44 | 45 | $1 \times 10^{10}$ | A | A |
| Example 5 | 72 | 42 | 45 | $1 \times 10^{9}$ | A | A |
| Example 6 | 72 | 60 | 30 | $2 \times 10^{13}$ | C | C |
| Example 7 | 72 | 47 | 31 | $5 \times 10^{6}$ | C | A |
| Example 8 | 72 | 46 | 35 | $1 \times 10^{13}$ | B | C |
| Example 9 | 72 | 48 | 30 | $7 \times 10^{11}$ | B | B |
| Comparative Example 1 | 35 | 60 | 37 | $4 \times 10^{10}$ | D | A |
| Comparative Example 2 | — | 42 | 45 | Insulation ($1 \times 10^{14}$ or more) | A | D |

TABLE 2

| | Take-up speed m/min | extrusion speed g/min | Inner diameter of Ring-shaped die mm | Die gap of ring-shaped die mm |
|---|---|---|---|---|
| Example 1 | 2.5 | 53 | 75 | 0.8 |
| Example 2 | 2.9 | 39 | 75 | 1.8 |
| Example 3 | 2.6 | 46 | 75 | 1.3 |
| Example 4 | 2.6 | 44 | 75 | 1.5 |

TABLE 2-continued

| | Take-up speed m/min | extrusion speed g/min | Inner diameter of Ring-shaped die mm | Die gap of ring-shaped die mm |
|---|---|---|---|---|
| Example 5 | 2.1 | 36 | 80 | 1.2 |
| Example 6 | 3.3 | 38 | 80 | 2.8 |
| Example 7 | 2.7 | 32 | 75 | 1.3 |
| Example 8 | 2.6 | 34 | 80 | 1.2 |
| Example 9 | 2.6 | 30 | 80 | 1.3 |
| Comparative Example 1 | 3.2 | 45 | 75 | 3.6 |
| Comparative Example 2 | 2.2 | 37 | 85 | 1.1 |

As described above, an endless belt-shaped electrophotographic member can be obtained which include a cylindrical or columnar substrate, a rubber elastic layer that covers the periphery of the substrate, and a fluororesin tube that covers the periphery of the rubber elastic layer, wherein the fluororesin tube is crystalline-orientated in the substantially axial direction of the substrate and includes a fluororesin and carbon black dispersed in the fluororesin, and the primary average particle diameter of the carbon black is 50 nm or more and 100 nm or less.

Thus, an electrophotographic member can be provide in which peeling offset is suppressed and at the same time a high cracking resistance is highly achieved, and a fixing apparatus including the electrophotographic member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-036781, filed Feb. 27, 2014, which is hereby incorporated by reference herein in its entirety.

What is claimed is:

1. An endless belt-shaped electrophotographic member, comprising:

a substrate;

a rubber elastic layer that covers a periphery of the substrate; and a fluororesin tube that covers a periphery of the rubber elastic layer, wherein:

the fluororesin tube includes a fluororesin and carbon black dispersed in the fluororesin, the fluororesin is crystalline-oriented in a substantially longitudinal direction of the substrate, and a primary average particle diameter of the carbon black is from 55 nm to 100 nm.

2. The electrophotographic member according to claim 1, wherein a degree of crystalline orientation of the fluororesin in the substantially longitudinal direction of the substrate is from 35% to 50%.

3. The electrophotographic member according to claim 1, wherein the fluororesin is a copolymer of polytetrafluoroethylene and perfluoroalkyl vinyl ether.

4. The electrophotographic member according to claim 1, wherein a thickness of the fluororesin tube is from 35 μm to 55 μm.

5. The electrophotographic member according to claim 1, wherein a surface resistance of the electrophotographic member is from $1\times10^{7}$ Ω/m$^2$ to $1\times10^{12}$ Ω/m$^2$.

6. A fixing apparatus comprising:

a heating member; and an endless belt-shaped electrophotographic member that is disposed opposite to the heating member and that forms a nip together with the heating member, wherein the electrophotographic member is the electrophotographic member according to claim 1.

7. The fixing apparatus according to claim 6, wherein the electrophotographic member is suspended under tension between at least two rollers.

* * * * *